US010101029B2

(12) United States Patent
Propheter-Hinckley et al.

(10) Patent No.: US 10,101,029 B2
(45) Date of Patent: Oct. 16, 2018

(54) COMBUSTOR PANELS AND CONFIGURATIONS FOR A GAS TURBINE ENGINE

(71) Applicant: UNITED TECHNOLOGIES CORPORATION, Farmington, CT (US)

(72) Inventors: Tracy A. Propheter-Hinckley, Manchester, CT (US); Dominic J. Mongillo, West Hartford, CT (US); Mark F. Zelesky, Bolton, CT (US); Joel H. Wagner, Wethersfield, CT (US); William A. Sowa, Simsbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 315 days.

(21) Appl. No.: 14/673,622

(22) Filed: Mar. 30, 2015

(65) Prior Publication Data

US 2016/0290647 A1 Oct. 6, 2016

(51) Int. Cl.

| | |
|---|---|
| ***F23R 3/06*** | (2006.01) |
| ***F23R 3/00*** | (2006.01) |
| ***F23R 3/60*** | (2006.01) |

(52) U.S. Cl.

CPC ..... *F23R 3/002* (2013.01); *F23R 3/007* (2013.01); *F23R 3/60* (2013.01); (Continued)

(58) Field of Classification Search

None

See application file for complete search history.

(56) References Cited

U.S. PATENT DOCUMENTS 4,414,816 A * 11/1983 Craig ..... F23R 3/002 60/757

6,047,552 A 4/2000 Gross et al.

(Continued)

FOREIGN PATENT DOCUMENTS

| | | |
|---|---|---|
| EP | 1591724 | 11/2005 |
| WO | 2014160565 A1 | 10/2014 |

OTHER PUBLICATIONS

European Search Report, European Application No./Patent No. 16162429.1-1602, dated Nov. 8, 2016, European Patent Office; European Search Report 8 pages.

*Primary Examiner* — Christopher Verdier
*Assistant Examiner* — Maxime Adjagbe
(74) *Attorney, Agent, or Firm* — CANTOR COLBURN LLP

(57) ABSTRACT

The present disclosure relates to combustor configurations, panels and components for a gas turbine engine. In one embodiment, a combustor for a gas turbine engine includes a support structure including a plurality of openings and a plurality of panels mounted to the structure. The plurality of panels define a combustion cavity of the combustor. Each panel includes a first wall configured to receive cooling air and a second wall configured to provide air flow for the cavity. The first and second walls form a cavity and include one or more elements for controlling the cooling effectiveness of each panel. Another embodiment is directed to a combustor panel including one or more elements for controlling cooling effectiveness. Another embodiment is directed to a support structure for a combustor of a gas turbine engine. Another embodiment is directed to configurations of panels including single walled portions or single walled panels.

19 Claims, 8 Drawing Sheets

(52) U.S. Cl.
CPC ..... *F23R 2900/00018* (2013.01); *F23R 2900/03041* (2013.01); *F23R 2900/03042* (2013.01); *F23R 2900/03044* (2013.01); *F23R 2900/03045* (2013.01)

(56) References Cited

U.S. PATENT DOCUMENTS

| | | | | | |
|---|---|---|---|---|---|
| 6,155,055 | A * | 12/2000 | Forestier | F23R 3/34 | 60/747 |
| 6,408,628 | B1 * | 6/2002 | Pidcock | F23R 3/002 | 60/752 |
| 7,140,185 | B2 * | 11/2006 | Burd | F23M 5/085 | 110/336 |
| 8,122,726 | B2 | 2/2012 | Tschirren et al. | | |
| 2003/0177770 | A1 | 9/2003 | Hofmann et al. | | |
| 2010/0242487 | A1 * | 9/2010 | Davis, Jr. | F01D 9/023 | 60/772 |
| 2011/0247590 | A1 * | 10/2011 | Donovan | F23R 3/283 | 123/470 |
| 2012/0275900 | A1 | 11/2012 | Snider et al. | | |
| 2013/0025287 | A1 * | 1/2013 | Cunha | F23R 3/002 | 60/772 |
| 2014/0360196 | A1 * | 12/2014 | Graves | F23R 3/002 | 60/753 |

* cited by examiner

COMBUSTOR PANELS AND CONFIGURATIONS FOR A GAS TURBINE ENGINE

CROSS-REFERENCE TO RELATED APPLICATION

This application is related to the concurrently filed application titled: COMBUSTOR CONFIGURATIONS FOR A GAS TURBINE ENGINE filed on Mar. 30, 2015 assigned patent application Ser. No. 14/673,629, the disclosure of which is expressly incorporated by reference.

FIELD

The present disclosure relates to gas turbine engines and, in particular, to combustor configurations and components for gas turbine engines.

BACKGROUND

Gas turbine engines are required to operate efficiently during operation and flight. Theses engines create a tremendous amount of force and generate high levels of heat. As such, components of these engines are subjected to high levels of stress, temperature and pressure. It is necessary to provide components that can withstand the demands of a gas turbine engine. It is also desirable to provide components with increased operating longevity.

Conventional gas turbine engine combustors can include a combustor shell. The conventional combustor shell and its typical arrangement provide air flow to a combustor cavity. However, the conventional arrangements may be limited by the amount of cooling air flow provided to the cavity. Due to pressure differential between the conventional combustor shell and liner elements, cooling flow may not be easily controlled. In addition, conventional combustor shells result in a pressure drop across the shell that can reduce the cooling flow to elements within the combustion chamber. Accordingly, there is a desire to improve combustion cooling and provide a configuration that allows for improved cooling characteristics. There is also a desire to improve the configuration of gas turbine engines and combustors.

BRIEF SUMMARY OF THE EMBODIMENTS

Disclosed and claimed herein are combustor configurations and components for gas turbine engines. One embodiment is directed to a combustor for a gas turbine engine, the combustor including a support structure including a plurality of openings and a plurality of panels mounted to the structure. The plurality of panels define a combustion cavity of the combustor, and each panel includes a first wall configured to receive cooling air and a second wall configured to provide air flow for the cavity, the first and second walls forming a cavity and including one or more elements for controlling the cooling effectiveness of each panel.

In one embodiment, the support structure includes one or more sections configured to provide a mounting structure for the plurality of panels, wherein the mounting structure is at least one of an annular, can, and lattice structure.

In one embodiment, the plurality of openings in the support structure allow for primary airflow received by the combustor to be channeled without a pressure drop to the first wall of the plurality of panels.

In one embodiment, each panel is configured with a particular cooling effectiveness.

In one embodiment, panel cavities include cooling features associated with one or more of trips, pedestals, pin fin features and cooling features in general.

In one embodiment, the combustor further includes sealing elements between lateral surfaces of each panel, wherein the sealing elements are at least one of a ship lap seal and w seal.

In one embodiment, the plurality of panels are additively manufactured.

In one embodiment, the plurality of panels additionally include one or more single walled panels mounted to the support structure.

In one embodiment, the plurality of panels include one or more single walled portions.

One embodiment is directed to a combustor panel for a gas turbine engine, the combustor panel including a first wall configured to receive air flow for the combustor panel and a second wall configured to provide air flow for the cavity, the first and second walls forming a cavity. The combustor panel includes one or more elements for controlling the cooling effectiveness between the first and second wall.

In one embodiment, the combustor panel is configured for mounting to a support structure including one or more sections configured to provide a mounting structure for the panel, wherein the mounting structure is at least one of an annular, can, and lattice structure.

In one embodiment, the panel receives air flow from a plurality of openings in a support structure and channels airflow into a combustion chamber.

In one embodiment, the panel is configured with a particular cooling effectiveness, and wherein the panel cavity includes cooling features associated with one or more of trips, pedestal, pin fin features and cooling features in general.

In one embodiment, the panel is configured to engage with sealing elements along lateral surfaces of each panel, wherein the sealing elements are at least one of a ship lap seal and w seal.

In one embodiment, the panel is additively manufactured.

One embodiment is directed to a structure for a combustor of a gas turbine engine, the structure including a support structure including a plurality of openings and a plurality of retaining elements configured to secure a plurality of panels to the support structure, wherein the retaining elements are configured to retain a plurality of panels to define a combustion cavity of the combustor.

In one embodiment, the support structure includes one or more sections configured to provide a mounting structure for a plurality of panels, wherein the mounting structure is at least one of an annular, can, and lattice structure.

In one embodiment, the plurality of openings in the support structure allow for primary airflow received by a combustor to be channeled without a pressure drop into the plurality of panels.

In one embodiment, the support structure is a mounting structure for panels of a combustor cavity.

In one embodiment, the plurality of retaining elements include one or more of holding pins and holding features.

In one embodiment, the support structure includes one or more air pass-throughs that supply airflow to the combustion cavity.

In one embodiment, the support includes cooling features associated with one or more of trips, pedestal, pin fin features and cooling features in general within the support structure.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of this disclosure relates to configurations for combustors according to one or more embodiments. In one embodiment, a configuration is provided for a combustor having a plurality of panels retained by a support structure having a plurality of openings. The inclusion of openings in the support structure allows for the backside of the panels to be exposed. In addition, the openings in the support structure provide weight savings. In certain embodiments, panels of the combustor may be configured as dual-walled. In addition, one or more features may be provided for internal cooling of the panel elements.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1:
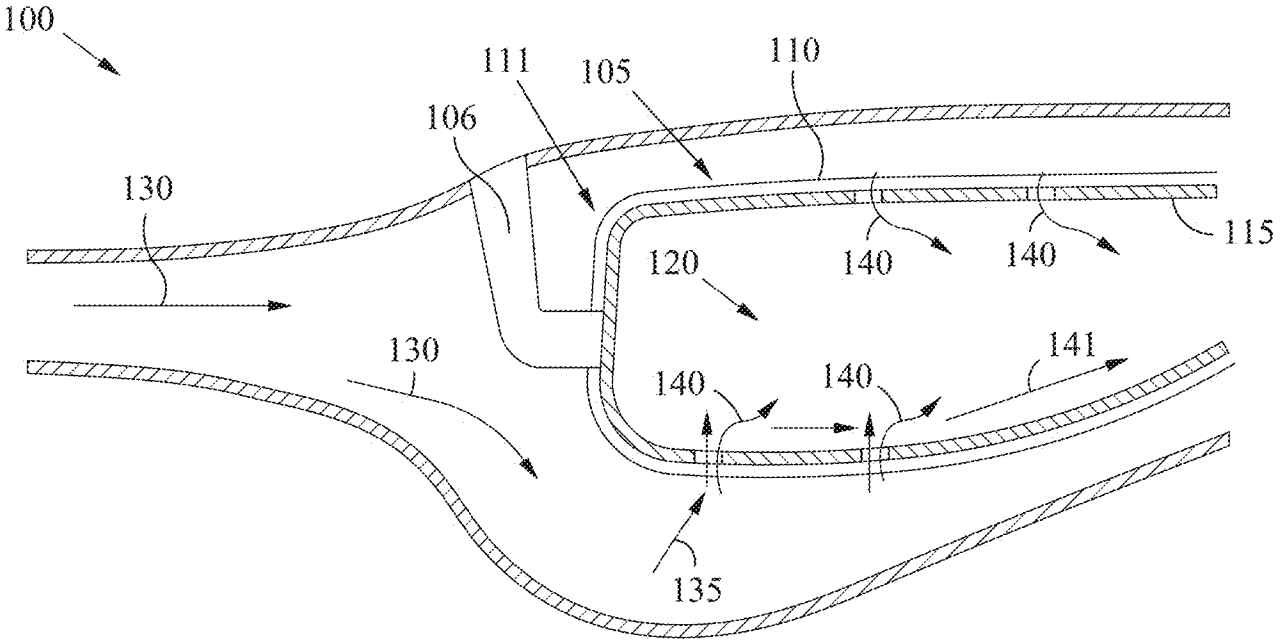
FIG. 1 depicts a cross-sectional representation of a combustor assembly for a gas turbine engine according to one or more embodiments.

FIG. 1 depicts a graphical representation of a gas turbine engine 100 and a combustor configuration according to one or more embodiments. Gas turbine engine 100 includes combustor 105 and a cross-sectional representation is shown of combustor 105 according to one or more embodiments. Combustor 105 includes a combustor structure 110 and one or more panel elements shown as 115. The panel element(s) 115 may form the combustion cavity 120 of combustor 105.

Combustor 105 may interface with fuel injector 106 and one or more diffusers. Combustor structure 110 may include one or more sidewalls configured to form at least one of a can shape, annulus shape, and combustor shape in general. Combustor bulkhead 111 may fit within the shape created by sidewalls of combustor structure 110. In certain embodiments, combustor bulkhead 111 can be an integral part of the combustor structure 110. Alternatively, combustor bulkhead 111 can be a separate part that is assembled to combustor structure 110.

Fuel injector 106 may interface with combustor bulkhead 111 as shown in FIG. 1 or through one or more other arrangements. By way of example, Fuel injector 106 may interface with combustor structure 110 at one or more other locations where panel element(s) 115 may or may not be involved.

According to one embodiment, combustor 105 employs combustor structure 110 and combustor bulkhead 111 to support panel element(s) 115. Unlike conventional combustors which employ a full metal combustor shell as a combustor sidewall, combustor structure 105 may be configured with one or more features to reduce weight, eliminate the pressure drop across the structure 105 and improve the cooling and flow metering characteristics for the combustor cavity. Conventional combustor shells and bulkheads are typically made of thin metal with multiple impingement holes for the back side of combustor liners.

Combustor structure 110 may provide a support system for dual walled liner elements, such as panel element(s) 115. Combustor structure 110 does not require a full continuous structural shell to support panel element(s) 115. Combustor structure 110 allows for large holes (e.g., larger than conventional cooling holes). As a result, combustor structure 110 provides significant weight savings. Moreover, combustor structure 110 does not require a configuration or feature to control or meter flow distribution and can act solely as a support feature for panel element(s) 115.

Figure 2B:
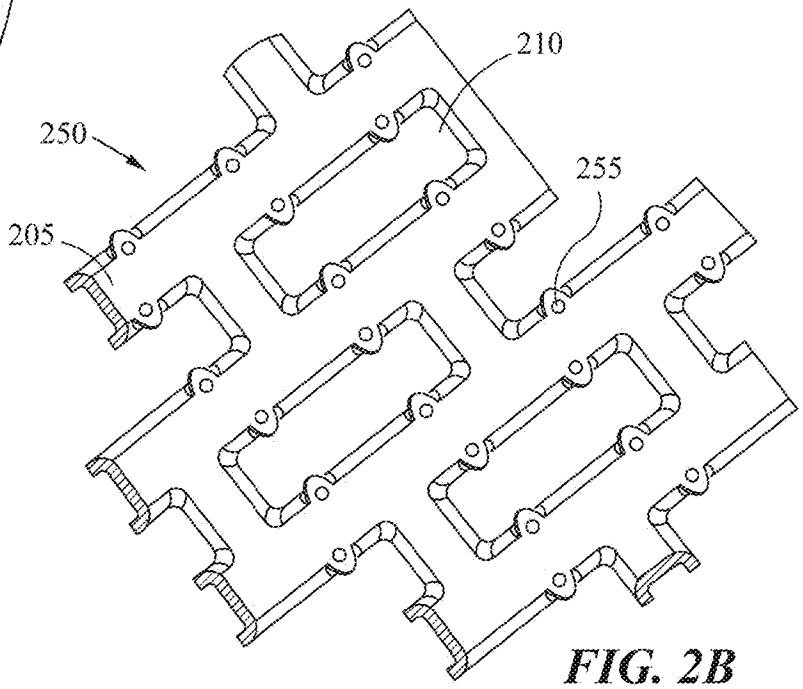
FIGS. 2A-2B depict graphical representations of a combustor structure according to one or more embodiments.
Figure 2A:
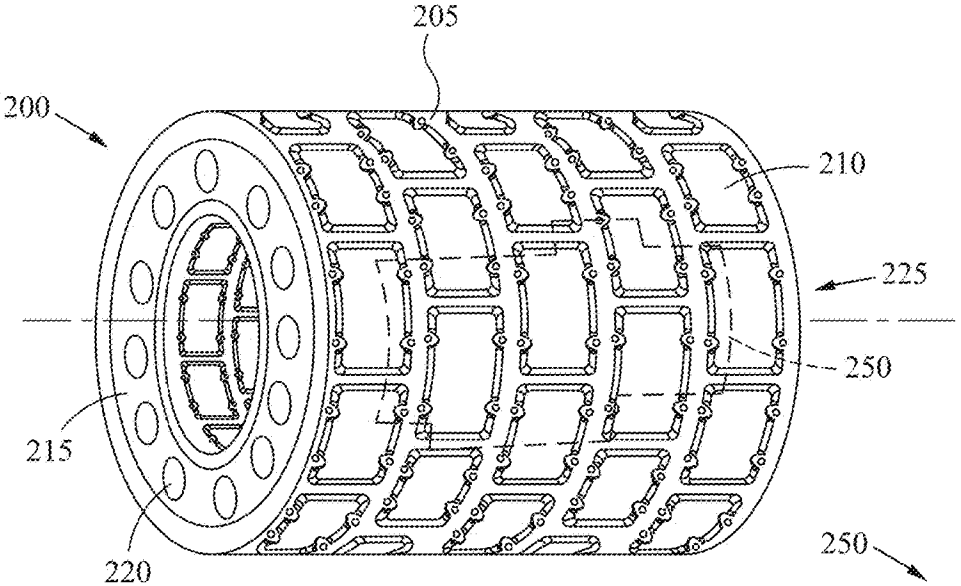

According to one embodiment, combustor structure 110 is a metal support structure including a plurality of holes/openings (shown in FIGS. 2A-2B). Unlike conventional combustor shells, combustor structure 110 does not result in a pressure drop of air supplied to panels. In certain embodiments, combustor structure 110 is a non-metal support structure, such as a ceramic matrix composite (CMC), etc. When formed from a CMC, combustor structure 110 can benefit from weight savings. According to one embodiment, combustor structure 110 may be a lattice structure as will be described in more detail below with reference to FIGS. 5A-5C.

According to one embodiment, panel element(s) 115 may include one or more dual-walled structures. Panel element(s) 115 may be very different than conventional liners. In some embodiments, panel element(s) 115 are dual walled and allow for cooling features internal to the panels. According to another embodiment, panel element(s) 115 may include a panel elements associated with one or more of single-walled and dual-walled panels. According to another embodiment, panel element(s) 115 may include one or more panel elements that are partially single-walled and partially dual-walled. By way of example, a portion of the panel may be dual walled to include cooling features such that those portions of the panel exposed to hot combustion gas products generated in combustor cavity 120 may be cooled. In addition, portions of panel element(s) 115 that are single walled may include one or more cooling holes.

Gas turbine engine 100 may provide air flow 130 to combustor 105. Airflow 130 may pass-through openings in combustor structure 110, shown as air flow 135. According to one embodiment, panel element(s) 115 may be configured to receive airflow 135 and meter air flow through the panel element(s) 115, which is shown as 140 for at least one of cooling and combustion air.

FIGS. 2A-2B depict graphical representations of a combustor structure according to one or more embodiments. Combustor structure 200 may relate to the combustor structure 110 of FIG. 1 according to one or more embodiments. In FIG. 2A, combustor structure 200 is shown as a substantially cylindrical mounting structure 205 having a plurality of openings 210. In certain embodiments, the ratio of openings 210 to solid mounting structure 205 may vary or change along the axial length of mounting structure 205. By way of example, at least one of size, position and number of openings 210 may be varied for mounting structure 205. According to one embodiment, combustor structure 200 may be one or more of an annular and can structure.

Mounting structure 205 may be configured to retain one or more panels on the inner surface of the structure. Mounting structure 205 may be configured to mount to and/or include combustor bulkhead 215. Optional opening 220 in combustor bulkhead 215 may allow for receiving a fuel nozzle (e.g., fuel nozzle 106). The exit area of mounting structure 205 is shown as 225.

FIG. 2B depicts a portion 250 of combustor structure 200 according to one or more embodiments. Portion 250 of combustor structure 200 is shown for the inner surface of mounting structure 205. Mounting structure 205 includes openings 210 and one or more mounting features 255 to allow for mounting of panel elements (e.g., panel element(s) 115).

Figure 3A:
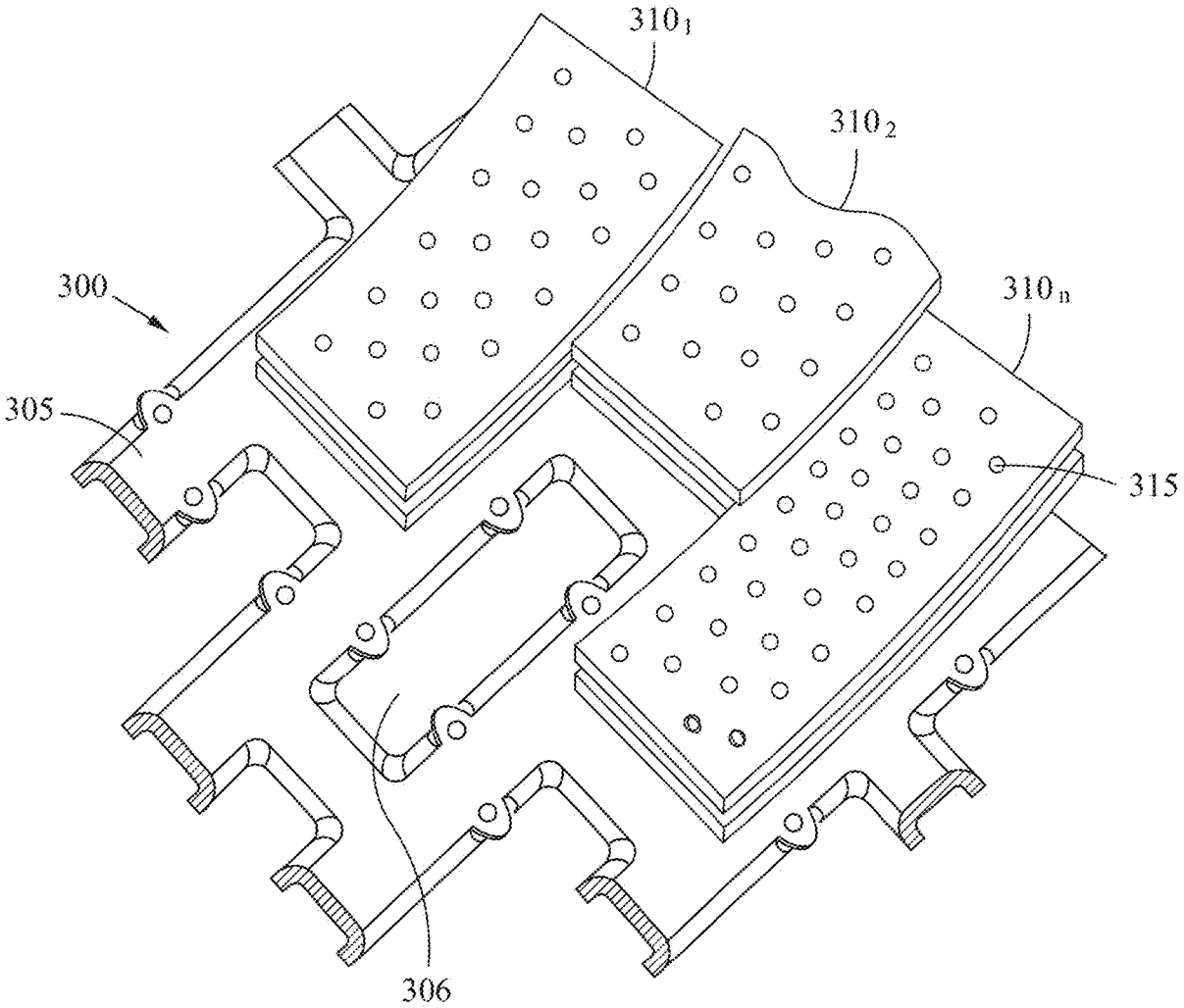
FIGS. 3A-3D depict graphical representations of a combustor assemblies according to one or more embodiments.

FIGS. 3A-3D depict graphical representations of a combustor assemblies according to one or more embodiments. The combustor structures and panel elements of FIGS. 3A-3D may relate to the combustor structure 110 and panel element(s) 115 of FIG. 1 according to one or more embodiments. In FIG. 3A, a partial representation of a combustor is shown as 300. Combustor 300 includes mounting structure 305 which may be configured to retain one or more panel elements $\mathbf{310}_{1\text{-}n}$ on the inner surface of the structure. Mounting structure 305 may be configured to mount to a combustor bulkhead. According to one embodiment, openings 306 in mounting structure 305 are configured to allow air flow to pass without a pressure drop to panel elements $\mathbf{310}_{1\text{-}n}$. Exits holes of panel elements $\mathbf{310}_{1\text{-}n}$ are shown as 315.

According to one embodiment, panel elements $\mathbf{310}_{1\text{-}n}$ each include internal cooling features. According to another embodiment, the panel elements $\mathbf{310}_{1\text{-}n}$ each include an internal cavity or core. According to another embodiment, panel elements $\mathbf{310}_{1\text{-}n}$ and cooling features of each element may be additively manufactured.

Figure 3B:
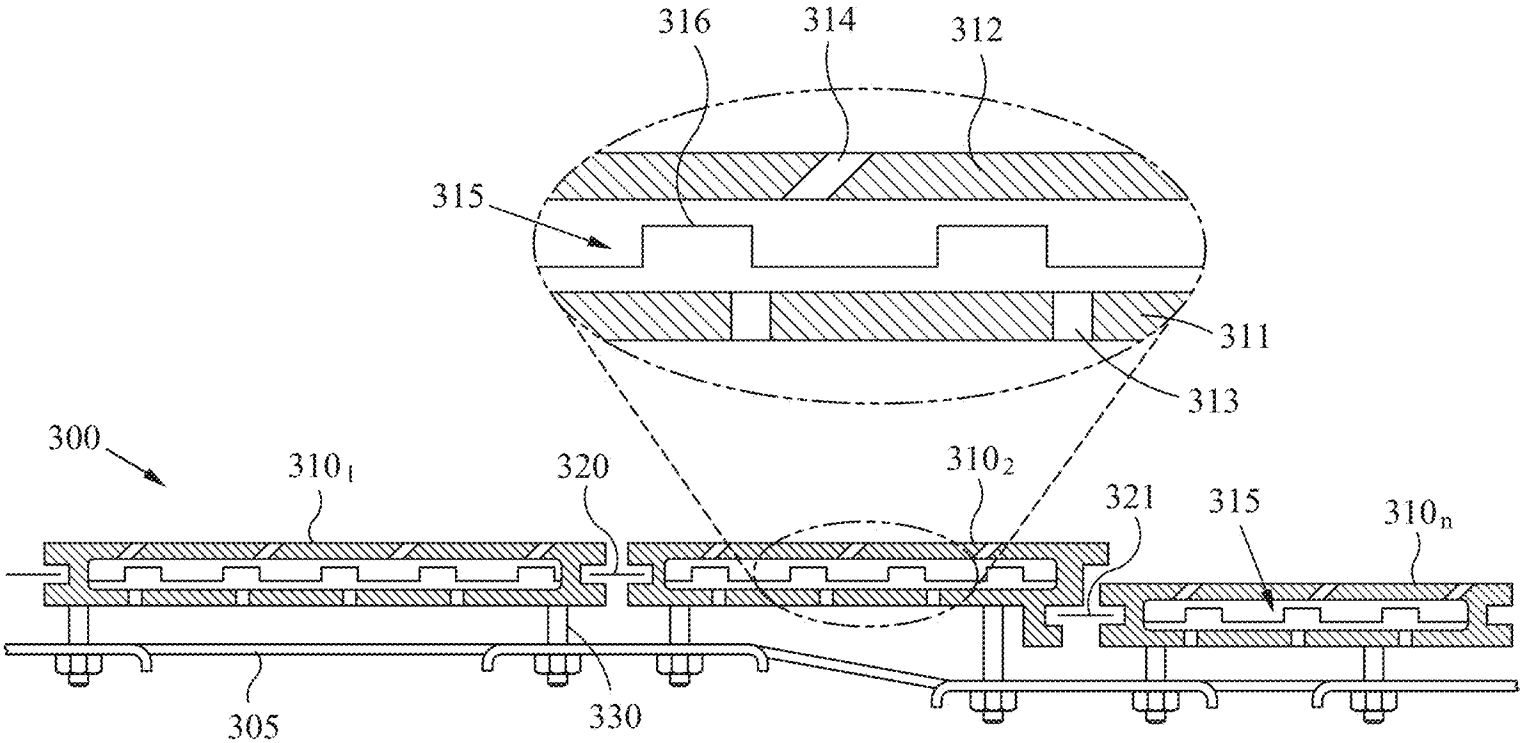

FIG. 3B depicts a cross-sectional representation of combustor 300 according to one or more embodiments. Panel elements $\mathbf{310}_{1\text{-}n}$ are mounted to the inner surface of mounting structure 305. Panel elements $\mathbf{310}_{1\text{-}n}$ each include a cavity or core, shown as 315. Panel elements $\mathbf{310}_{1\text{-}n}$ are shown as dual-walled structures according to one or more embodiments.

FIG. 3B depicts an enlarged representation of panel element, in particular panel elements $\mathbf{310}_2$. According to one or more embodiments, panel elements $\mathbf{310}_{1\text{-}n}$ may each include a first wall 311 with cooling holes 313 to receive cooling flow and a second wall 312 with holes 314 to output air flow from the panel element. According to another embodiment, panel elements $\mathbf{310}_{1\text{-}n}$ include heat transfer elements 316 in cavity 315.

According to one embodiment, panel elements $\mathbf{310}_{1\text{-}n}$ may be additively manufactured. In addition, panel elements $\mathbf{310}_{1\text{-}n}$ may act as combustor liners. The panel elements $\mathbf{310}_{1\text{-}n}$ each have heat transfer augmentation geometries or features 316 in cavity 315. Features 316 can include one or more of vessel cooling configurations, trip strips, pedestals, pin fin features, etc. Panel elements $\mathbf{310}_{1\text{-}n}$ do not require a conventional combustor shell, but can be utilized with a support of decreased weight. As such, the mounting structure 305 and panel elements significantly reduce the overall weight of the combustor, while increasing the durability of the panel elements.

According to one embodiment, each of the panel elements $\mathbf{310}_{1\text{-}n}$ may be configured to control the air flow through the panel elements to provide for cooling of each panel element and direct air flow out of the panel element. A drawback of conventional combustors is convective cooling through the back wall of the combustor which impinges on a single wall liner. Due to the pressure drop across the combustor shell of the conventional combustor, it is difficult to maintain and/or provide pressure to liners. Panel elements $\mathbf{310}_{1\text{-}n}$ may be configured to individually tailor the pressure drop across each individual element. Thus, unlike conventional liners, panel elements $\mathbf{310}_{1\text{-}n}$ may provide the ability to vastly improve control of airflow, and cooling effectiveness.

According to one embodiment, each of the panel elements $\mathbf{310}_{1\text{-}n}$ may interface with an adjoining panel element by a sealing configuration. In one embodiment, sealing configurations can include a feather seal 320. According to another embodiment, the sealing arrangement of adjoining panels can include a feather seal and ship-lap configuration 321. Feather seal 320 can improve sealing between panel elements $\mathbf{310}_{1\text{-}n}$. Each of the panel elements $\mathbf{310}_{1\text{-}n}$ can be coupled to mounting structure 305 by fasteners, shown as 330.

According to one embodiment, panel elements $\mathbf{310}_{1\text{-}n}$ may include a combination of single walled panels and dual walled panels mounted to a support structure, such as mounting structure 305. In one exemplary embodiment, one or more of panel elements $\mathbf{310}_{1\text{-}n}$ may include a first wall, such as first wall 311 with cooling holes 313, to receive cooling flow, the panel elements not including second wall. The single walled panel element configured to be supported by a support structure with openings, such as mounting structure 305. By way of example, a single walled panel may be employed in the front/forward end of a combustor 300 in areas with lower overall temperatures or in combustor configurations, such as an overall lean combustion system, that operate at lower overall wall temperatures.

According to an alternative embodiment, panel elements $\mathbf{310}_{1\text{-}n}$ may include one or more panels with single walled portions or single walled sections. By way of example, combustor 300 may include dual wall panel elements $\mathbf{310}_{1\text{-}n}$ with one or more localized single wall sections. In one exemplary embodiment, one or more of panel elements $\mathbf{310}_{1\text{-}n}$ may be configured to include a single wall section near front ends/leading edges, the panel transitioning into a dual wall panel further down the axial length of the combustor panel.

Figure 3C:
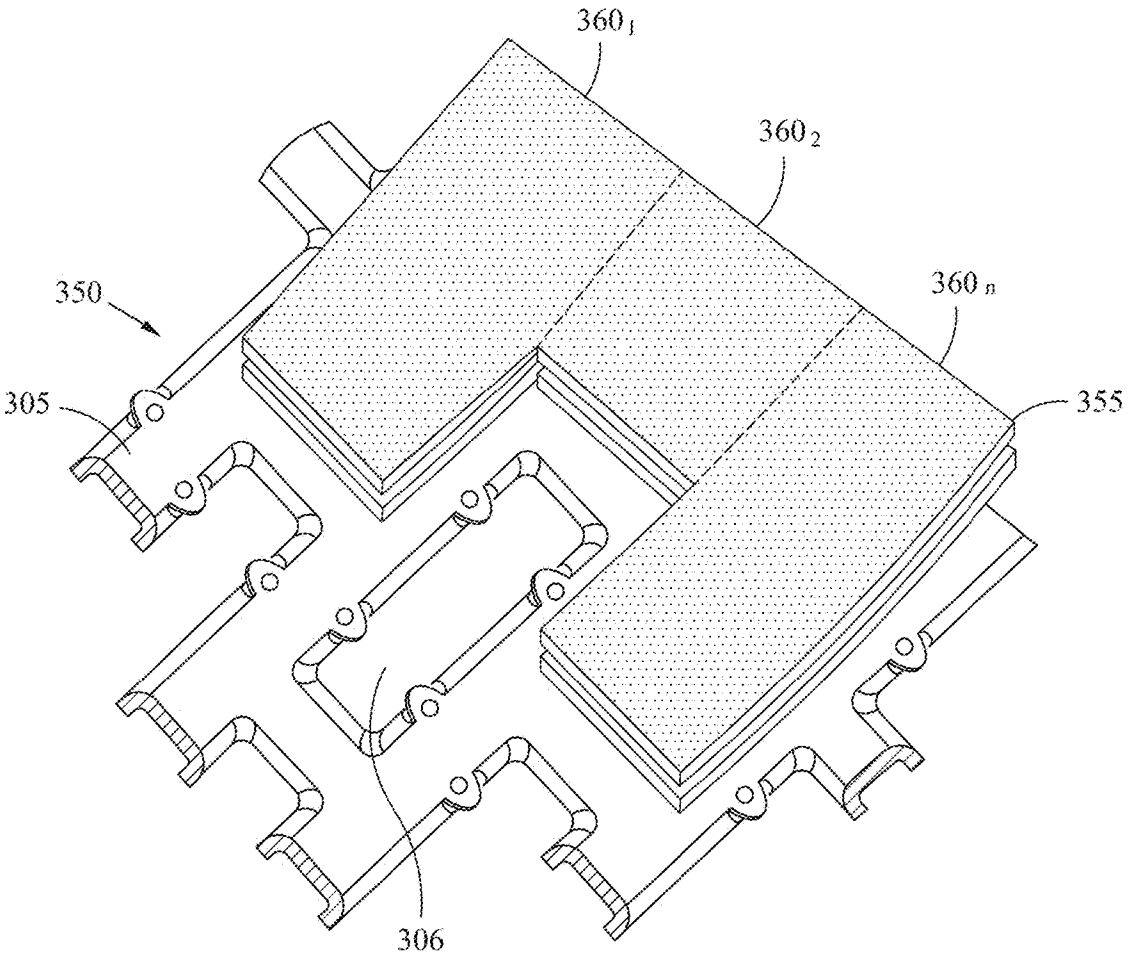

FIG. 3C depicts a mounting structure and panel element configuration according to another embodiment. According to one embodiment, a combustor 350 includes a panel element 355 mounted to the inner surface of mounting structure 305.

According to one embodiment, panel elements 355 includes internal cooling features. According to another embodiment, the panel element 355 includes an internal cavity or core. According to another embodiment, panel element 355 and cooling features of the panel may be additively manufactured.

According to one embodiment, panel element 355 can be configured with one or more zones or cooling configurations, shown as panel elements $\mathbf{360}_{1\text{-}n}$, within the panel.

Figure 3D:
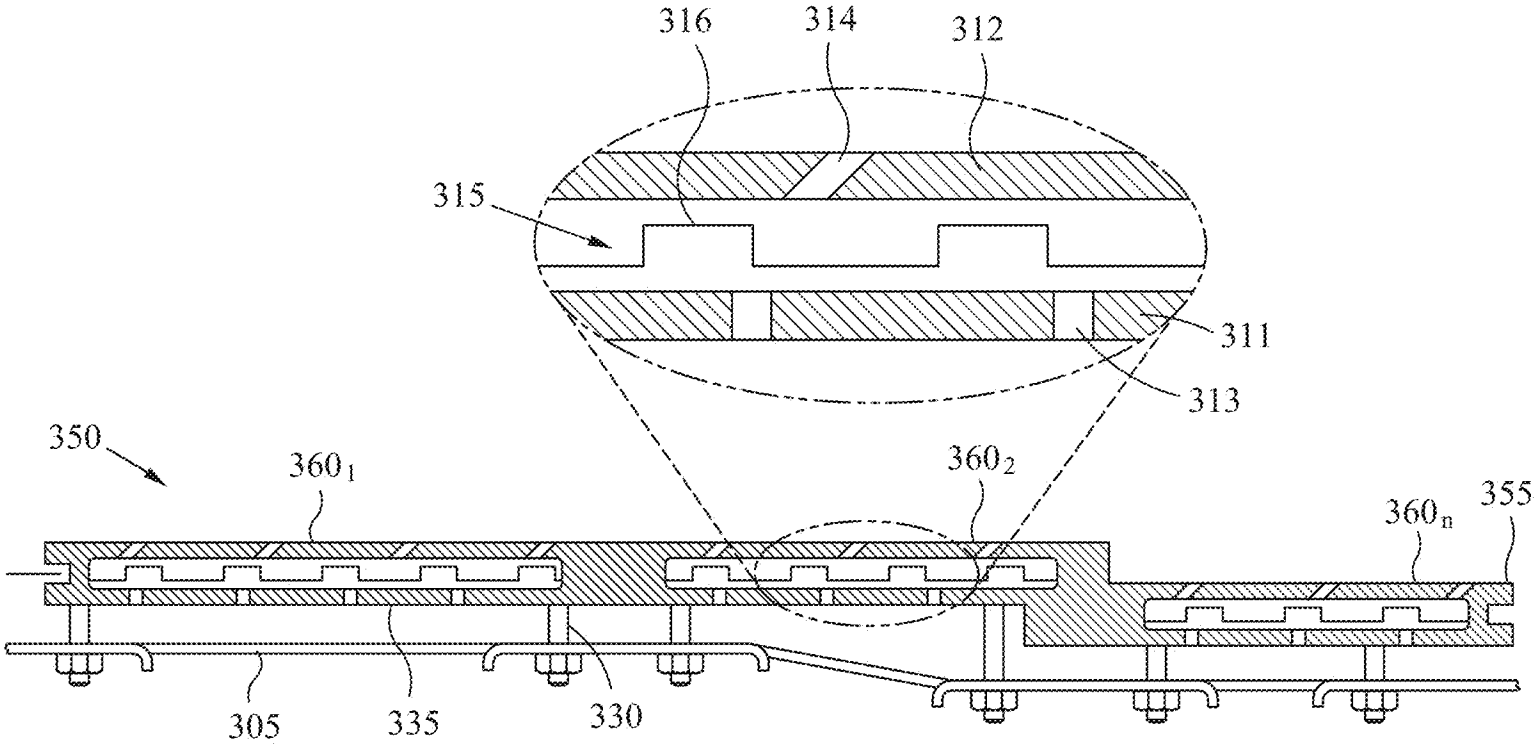

FIG. 3D depicts a cross-sectional representation of combustor 350 according to one or more embodiments. Panel element 355 is mounted to the inner surface of mounting structure 305. Panel element 355 includes a cavity or core, shown as 315. Panel element 355 is shown as a dual-walled structure according to one or more embodiments.

FIG. 3D depicts an enlarged representation of panel element 355. According to one or more embodiments, panel element 355 may include a first wall 311 with cooling holes 313 to receive cooling flow and a second wall 312 with holes 314 to output air flow from the panel element. According to another embodiment, panel element 355 includes heat transfer elements 316 in cavity 315.

According to one embodiment, panel element 355 may be additively manufactured. In addition, panel element 355 may act as a combustor liner. Panel element 355 each have heat transfer augmentation geometries or features 316 in cavity 315.

According to one embodiment, panel element 355 may interface with an adjoining panel element by a sealing configuration. In one embodiment, sealing configurations can include a feather seal. According to another embodiment, the sealing arrangement of adjoining panels can include a feather seal and ship-lap configuration.

According to one embodiment, panel element 355 may include a combination of single walled and dual walled sections mounted to a support structure, such as mounting structure 305. In one exemplary embodiment, one or more portions/sections of panel element 355, such as panel elements $\mathbf{360}_{1\text{-}n}$, may include a first wall, such as first wall 311 with cooling holes 313, to receive cooling flow, the panel elements not including second wall. The single walled section configured to be supported by a support structure with openings, such as mounting structure 305. By way of example, a single walled section of panel elements $\mathbf{360}_{1\text{-}n}$ may be employed in the front/forward end of a combustor 300 in areas with lower overall temperatures or in combustor configurations, such as an overall lean combustion system, that operate at lower overall wall temperatures. By way of example, combustor 350 may include dual wall panel elements $\mathbf{360}_{1\text{-}n}$ with one or more localized single wall sections. In one exemplary embodiment, one or more of panel elements $\mathbf{360}_{1\text{-}n}$ may be configured to include a single wall section near front ends/leading edges, the panel transitioning into a dual wall panel further down the axial length of the combustor panel.

Figure 4:
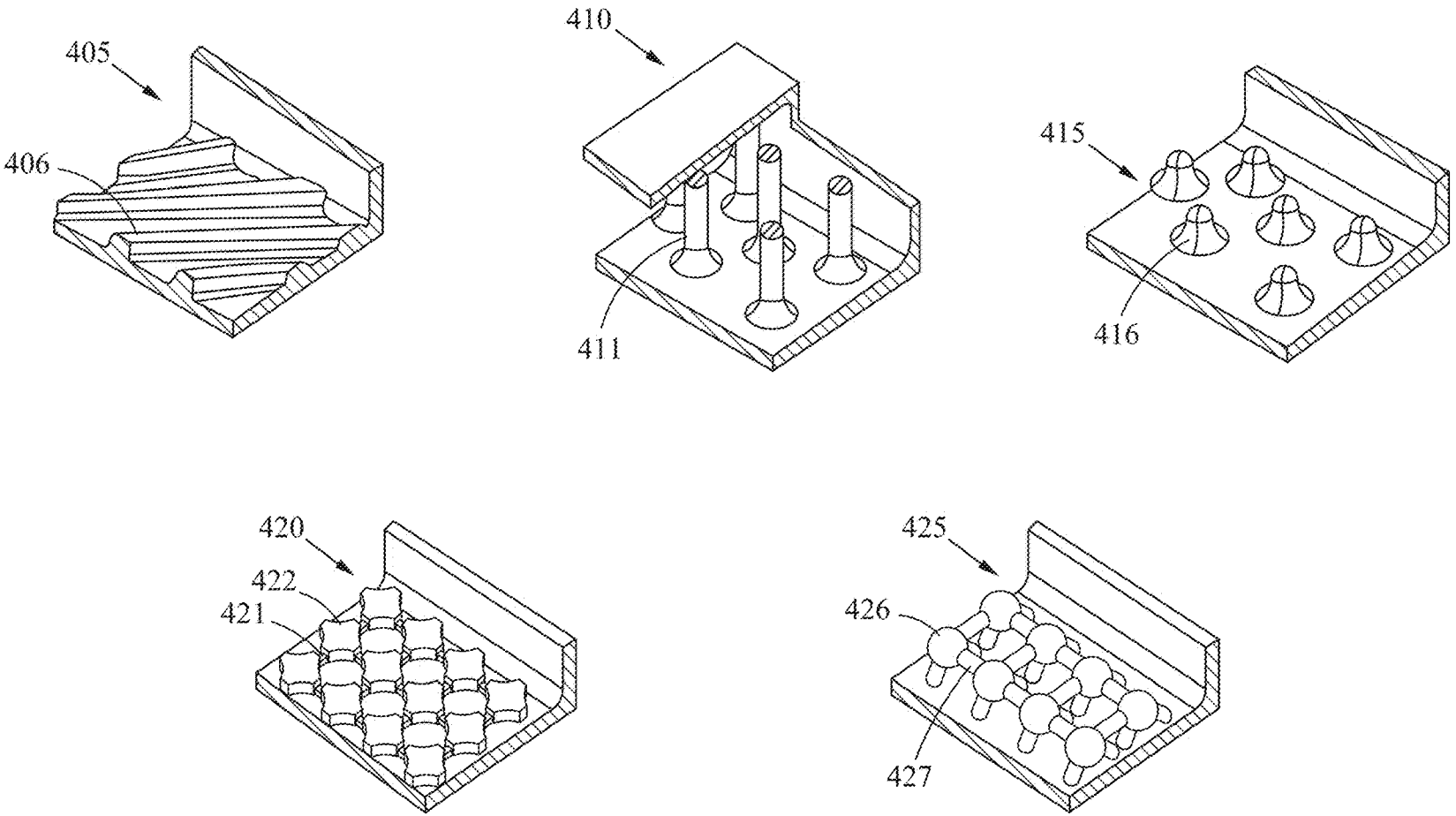
FIG. 4 depicts graphical representations of panel elements according to one or more embodiments.

FIG. 4 depicts graphical representations of cooling features for panel elements according to one or more embodiments. According to one embodiment, one or more of trips 405, pedestals 410, and pin fin features 415 may be employed as cooling features within panel elements, such as within a panel cavity (e.g., cavity 315). According to one embodiment, trips 405 relate to one or more raised ridges or strips, shown as 406, along the interior/inner wall of a panel element (e.g., within the panel element(s) 115). Pedestals 410 relate to one or more cylindrical or pillar structures, shown as 411, extending between inner walls of a panel element (e.g., within the panel element(s) 115). Pin fin features 415 relate to one or more raised elements, shown as 416, along the interior/inner wall of a panel element (e.g., within the panel element(s) 115).

Cooling features 420 and 425 are shown as combination cooling geometries, and include one or more of trips, pedestals, and pin fin features.

It should be appreciated that one or more of the cooling features of FIG. 4 may be employed within a cavity of a panel or series of panels. According to one exemplary embodiment, cooling features 420 include pedestals 422 having a particular cross-section shape (e.g., quadrilateral, polygon, star, etc.) wherein each pedestal 422 of features 420 includes a connection point 421 with another pedestal. As shown in FIG. 4, cooling features 420 include areas of separation between each pedestal 422. According to one embodiment, pedestals 422 may be positioned on a first wall of the cooling panel and may, or may not, extend to the other wall of the cooling panel. According to another exemplary embodiment, cooling features 425 include a plurality of elements 426 with connection posts 427. Elements 426 may be spherical shaped elements elevated/separated from a panel wall by posts 427.

Figure 5C:
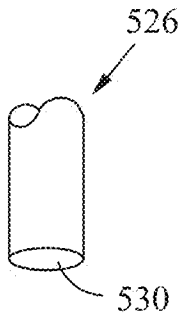
FIGS. 5A-5C depict graphical representations of a combustor support structure according to one or more embodiments.
Figure 5B:
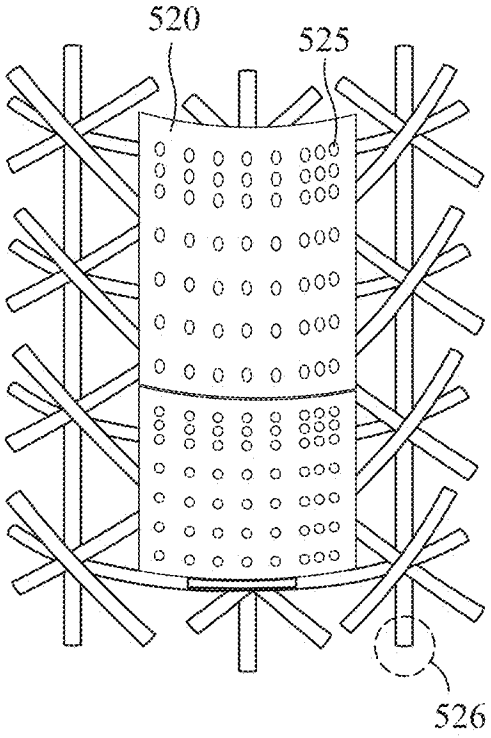
Figure 5A:
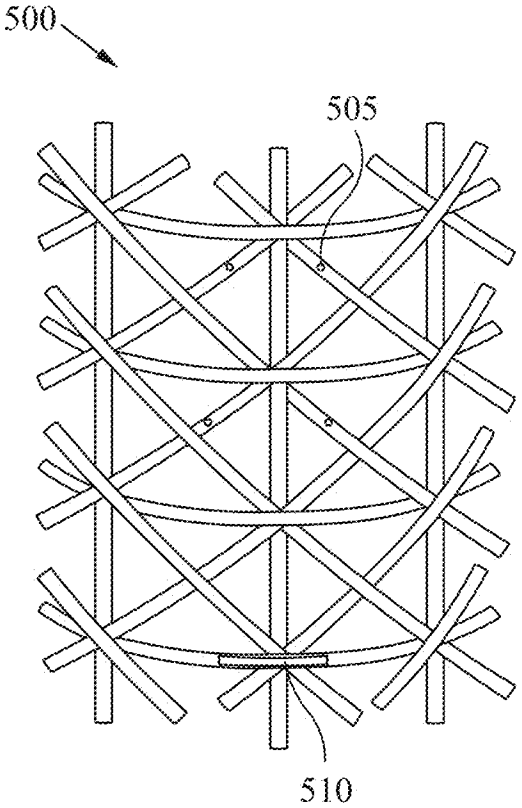

FIGS. 5A-5C depict graphical representations of a combustor support structure according to one or more embodiments. FIG. 5A depicts a combustor support structure (e.g., combustor sidewall) 500 as a lattice structure according to one embodiment. Combustor structure 500 may be a metal structural lattice. The geometry, sizing and openings of combustor structure 500 may be formed to one or more shapes and designs that can be utilized in a gas turbine engine. Combustor structure 500 can include features to attach panel elements (e.g., panel element(s) 115), bulkheads and to connect to a turbine inlet of a gas turbine engine. By way of example, combustor structure 500 can include alignment pins 505 and can rest on holding features 510 (e.g., mounting structures, support features, etc.) that can be sized and shaped according to requirements of the panel element(s). FIG. 5B depicts combustor structure 500 with panel element(s) 520 which may be placed on and/or attached by one or more of alignment pins 505, holding features 510 as well as fasteners (e.g., fasteners 330). Panel element(s) 520 may include one or more features of the panel elements discussed above with reference to FIGS. 3A-3B and 4 to meter cooling effectiveness and may also include cooling holes 525. In one embodiment, panel element(s) 520 are secured against lattice of combustor structure 500 without requiring sealing against the combustion structure. According to another embodiment, combustor structure 500 may include a sealing arrangement for adjoining panels of panel element(s) 520 that can include one or more of a feather seal and ship-lap configuration.

According to one embodiment, lattice of combustor structure 500 may be additively manufactured, including internal and external features. By way of example, combustor structure 500 may include internal cooling passages that may use one or more of the cooling features described above, such as trips, pedestals, and pin fins as cooling feature. In one embodiment, combustor structure 500 is a lattice structure with hollow flow passages. FIG. 5C depicts a graphical representation lattice structure elements with pass-through 530. Pass-through 530 of combustor structure 500 can output metered air through the lattice structure and in particular to portions which may be exposed to a combustion cavity. As such, locations where lattice air is introduced into a flow cavity of combustor structure 500 may be chosen to facilitate combustor performance or to increase system part life.

While this disclosure has been particularly shown and described with references to exemplary embodiments thereof, it will be understood by those skilled in the art that various changes in form and details may be made therein without departing from the scope of the claimed embodiments.

What is claimed is:

1. A combustor for a gas turbine engine, the combustor comprising:

a support structure including a plurality of openings; and a plurality of panels mounted to the support structure, wherein the plurality of panels define a combustion cavity of the combustor, and wherein each panel is a dual-walled panel having a first wall configured to receive cooling air into a cavity formed between the first wall and a second wall configured to provide an output air flow from the cavity, the cavity including one or more cooling features extending from at least one of the first and second walls for controlling a cooling effectiveness of each panel, wherein the support structure includes a plurality of lattice structure elements, wherein one or more air pass-throughs are formed as hollow flow passages within the lattice structure elements that supply metered airflow to the combustion cavity.

2. The combustor of claim 1, wherein the support structure includes one or more sections configured to provide a mounting structure for the plurality of panels, wherein the mounting structure is at least one of an annular, can, and lattice structure.

3. The combustor of claim 1, wherein the plurality of openings in the support structure allow for primary airflow received by the combustor to be channeled without a pressure drop to the first wall of the plurality of panels.

4. The combustor of claim 1, wherein panel cavities include cooling features associated with one or more of trips, pedestals, pin fin features and cooling features in general.

5. The combustor of claim 1, wherein the plurality of panels additionally include one or more single walled panels mounted to the support structure.

6. The combustor of claim 1, wherein the plurality of panels include one or more single walled portions.

7. The combustor of claim 1, wherein the dual-walled panel includes a single-walled portion, wherein the single-walled portion transitions into the first wall and the second wall down an axial length of the dual-walled panel.

8. The combustor of claim 6, wherein the single-walled portion defines a front end/leading edge of the dual-walled panel.

9. A combustor panel arrangement for a gas turbine engine, the combustor panel arrangement comprising:

a first dual-walled panel having a first wall configured to receive air flow for the combustor panel and a second wall configured to provide an output air flow from a cavity formed between the first and second walls;

one or more cooling features extending from at least one of the first and second walls for controlling a cooling effectiveness between the first and second wall of the first dual-walled panel;

a second dual-walled panel having a first wall configured to receive air flow for the combustor panel and a second wall configured to provide an output air flow from a cavity formed between the first and second walls;

one or more cooling features extending from at least one of the first and second walls for controlling a cooling effectiveness between the first and second wall of the second dual-walled panel; and a support structure including a plurality of lattice structure elements, wherein one or more air pass-throughs are formed as hollow flow passages within the lattice structure elements that supply metered airflow to a combustion cavity, wherein the first dual-walled panel and the second dual-walled panel are mounted to the support structure.

10. The combustor panel arrangement of claim 9, wherein the support structure includes one or more sections configured to provide a mounting structure for the panels, wherein the mounting structure is at least one of an annular, can, and lattice structure.

11. The combustor panel arrangement of claim 9, wherein each panel receives air flow from a plurality of openings in the support structure and channels airflow into the combustion chamber.

12. The combustor panel arrangement of claim 9, wherein each dual-walled panel is configured with a particular cooling effectiveness, and wherein the cooling features are one or more of trips, pedestal, and pin fin features.

13. The combustor panel arrangement of claim 9, wherein each panel is configured to engage with the feather seals along lateral surfaces of each panel.

14. The combustor panel of claim 9, wherein the dual-walled panel includes a single-walled portion, wherein the single-walled portion transitions into the first wall and the second wall down an axial length of the dual-walled panel.

15. A structure for a combustor of a gas turbine engine, the structure comprising:

a support structure including a plurality of openings and comprising a metal structural lattice; and a plurality of retaining elements configured to retain and secure a plurality of panels to the support structure to define a combustion cavity of the combustor, wherein the plurality of retaining elements comprise at least one alignment pin and at least one holding feature, wherein the support structure includes a plurality of lattice structure elements, wherein one or more air pass-throughs are formed as hollow flow passages within the lattice structure elements that supply metered airflow to the combustion cavity.

16. The structure of claim 15, wherein the plurality of openings in the support structure allow for primary airflow received by the combustor to be channeled without a pressure drop into the plurality of panels.

17. The structure of claim 15, wherein the support structure is a mounting structure for panels of the combustor cavity.

18. The structure of claim 15, wherein the lattice structure elements include cooling features associated with one or more of trips, pedestal, and pin fin features therein.

19. The structure of claim 15, further comprising a plurality of dual-walled panels mounted to the plurality of retaining elements, each dual-walled panel having (i) a first wall and a second wall forming a dual-walled portion and (i) a single-walled portion, wherein the single-walled portion transitions into the first wall and the second wall down an axial length of the dual-walled panel.

* * * * *